US011193438B1

(12) United States Patent
Zhang

(10) Patent No.: US 11,193,438 B1
(45) Date of Patent: Dec. 7, 2021

(54) EMISSIONS CONTROL DURING ENGINE COLD STARTS

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/192,207

(22) Filed: Mar. 4, 2021

(51) Int. Cl.

| | |
|---|---|
| ***F02D 13/02*** | (2006.01) |
| ***F02D 41/02*** | (2006.01) |
| ***F01N 3/02*** | (2006.01) |
| ***F01N 3/20*** | (2006.01) |

(52) U.S. Cl.
CPC ..... *F02D 41/0255* (2013.01); *F01N 3/2013* (2013.01); *F02D 13/0215* (2013.01); *F01N 2390/02* (2013.01); *F01N 2430/10* (2013.01); *F01N 2900/1602* (2013.01); *F02D 2200/0802* (2013.01)

(58) Field of Classification Search
CPC ..... F02D 13/0215; F02D 13/0261; F02D 41/0255; F02D 2200/0802; F01N 3/2013; F01N 2430/10; F01N 2390/02; F01N 2900/1602
See application file for complete search history.

(56) References Cited

U.S. PATENT DOCUMENTS

| | | | | |
|---|---|---|---|---|
| 7,255,081 | B2 * | 8/2007 | Sieber | F02D 41/0032 123/179.17 |
| 8,209,970 | B2 | 7/2012 | Gonze et al. | |
| 8,463,529 | B2 * | 6/2013 | Hu | B60W 10/26 701/104 |
| 9,038,376 | B2 | 5/2015 | Petrovic et al. | |
| 9,759,135 | B2 | 9/2017 | Ulrey et al. | |
| 2021/0156323 | A1 * | 5/2021 | Vassallo | F02D 41/0055 |

FOREIGN PATENT DOCUMENTS

| | | |
|---|---|---|
| DE | 102010033316 A1 | 4/2011 |
| JP | 2010202012 A | 9/2010 |

OTHER PUBLICATIONS

Zhang, X., "Methods and Systems for an Engine," U.S. Appl. No. 17/086,095, filed Oct. 30, 2020, 29 pages.

* cited by examiner

*Primary Examiner* — Audrey B. Walter
*Assistant Examiner* — Dapinder Singh
(74) *Attorney, Agent, or Firm* — Geoffrey Brumbaugh; McCoy Russell LLP

(57) ABSTRACT

Methods and systems are provided for an engine of a vehicle during a cold start. In one example, a method may include heating a catalyst of an exhaust aftertreatment device with a plurality of electric heaters during an unfueled engine operation. The engine may be operated as a pump to oscillate air across the exhaust aftertreatment device, thereby heating the air via the plurality of electric heaters which, in turn, heats the catalyst. A configuration of the catalyst may promote expedited light-off which may reduce emissions during the cold start.

20 Claims, 8 Drawing Sheets

EMISSIONS CONTROL DURING ENGINE COLD STARTS

FIELD

The present description relates generally to methods and systems for an engine during a cold start.

BACKGROUND/SUMMARY

Various strategies and technologies may be implemented in modern vehicles to reduce emissions. For example, one or more emission control devices may be included in vehicles with an internal combustion engine. The one or more emission control devices may include a catalyst configured to treat combustion by-products prior to atmospheric release. A conversion efficiency of the catalyst, however, is dependent on a temperature of the catalyst. As an example, a catalyst temperature below a threshold temperature, e.g., a light-off temperature, may degrade a capacity of the catalyst to treat emissions.

During engine cold starts, the catalyst temperature may be below the threshold temperature while hydrocarbon emissions may be elevated due to poor evaporation, fuel film formation, and insufficient time for the liquid fuel film to evaporate during intake and compression strokes. Evaporation of the film during an exhaust stroke may result in high hydrocarbon emissions to an exhaust system where catalysts may not yet be lit-off to oxidize the hydrocarbons.

Examples of attempts to address increased emissions during engine cold starts include application of electric heaters and complex coolant arrangements. However, these arrangements may increase manufacturing costs while also demanding pumps and valves to operate based on complex methods. Furthermore, a period of time for heating the catalyst to the light-off temperature may be undesirably slow due to a size and low thermal conductivity of the catalyst substrate. In addition, fuel film formation and poor evaporation during engine cold starts may lead to increased fuel consumption to compensate for fuel losses at the engine prior to the catalyst reaching a light-off temperature, which may further exacerbate emissions of hydrocarbons and reduce fuel efficiency.

In one example, the issues described above may be at least partially addressed by a method for an engine, including heating a catalyst of an exhaust aftertreatment device with a plurality of electric heaters during an unfueled engine operation by using the engine to oscillate air between a first direction and a second direction across the exhaust aftertreatment device. In this way, the exhaust aftertreatment device reaches the light-off temperature rapidly, enabling efficient catalytic conversion during cold engine starts.

As one example, the exhaust aftertreatment device may include a multi-substrate catalyst with multiple substrates stacked along a direction of air flow through the exhaust aftertreatment device. During an engine start, an unsparked, unfueled engine may be used to pump air as the engine is cranked with intake and exhaust valves of the engine open. Air is oscillated in the intake and exhaust systems (e.g., circulated back and forth relative to a direction of gas flow through the exhaust system) and air in the exhaust system may be heated by the plurality of electric heaters which are sandwiched between the substrates of the multi-substrate catalyst. Oscillation of heated air while the engine is unfueled delays generation of emissions until one or more of the substrates reaches a light-off temperature. The engine may then be started without a loss of conversion efficiency at the catalyst, thus reducing emissions during cold starts and maintaining a fuel economy of the vehicle.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
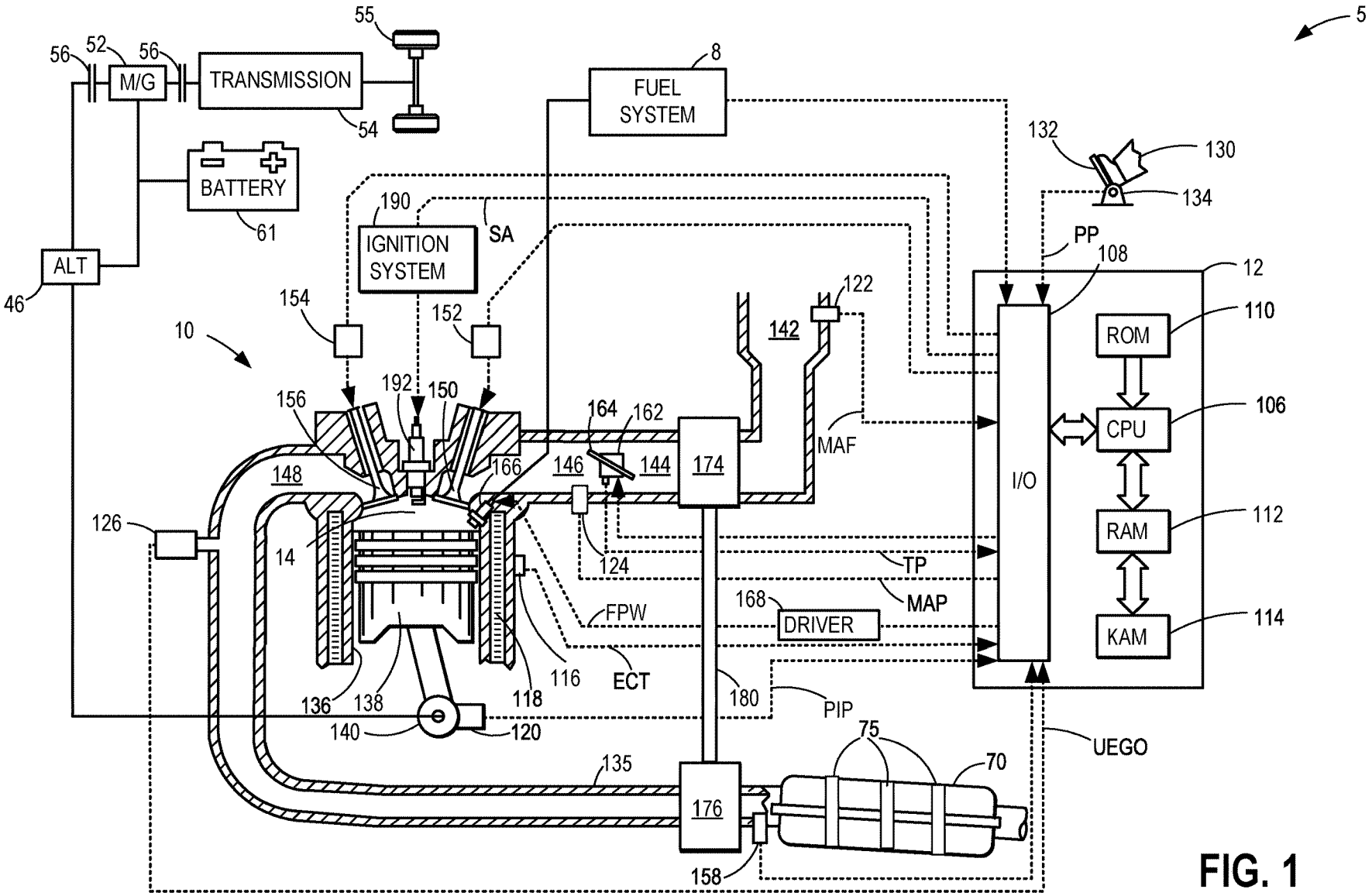
FIG. 1 illustrates a schematic of an engine included in a hybrid vehicle, the engine including an exhaust system with an aftertreatment device.
Figure 2A:
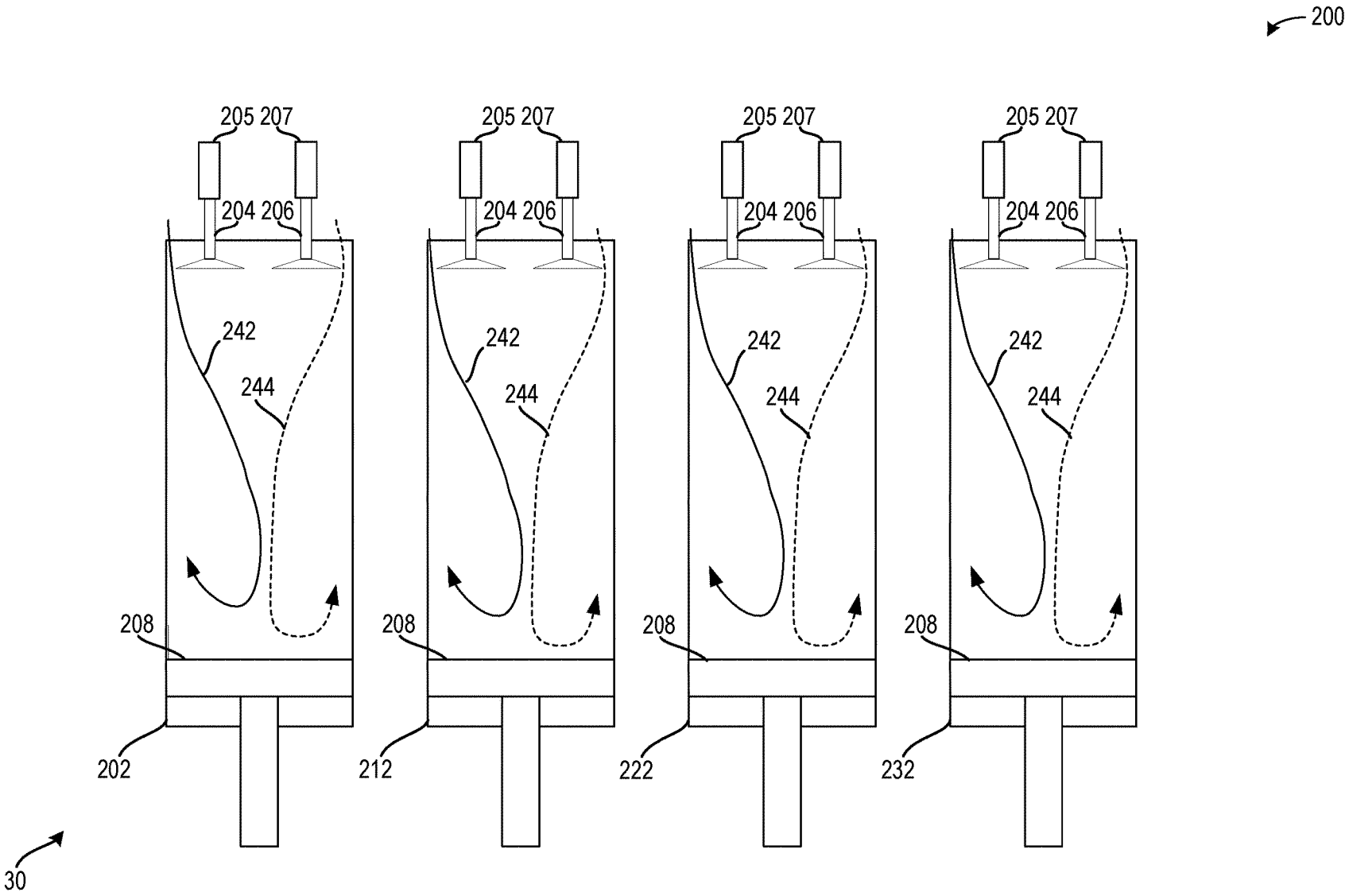
FIG. 2A illustrates a first example operation of a plurality of cylinders during an engine start request.
Figure 2B:
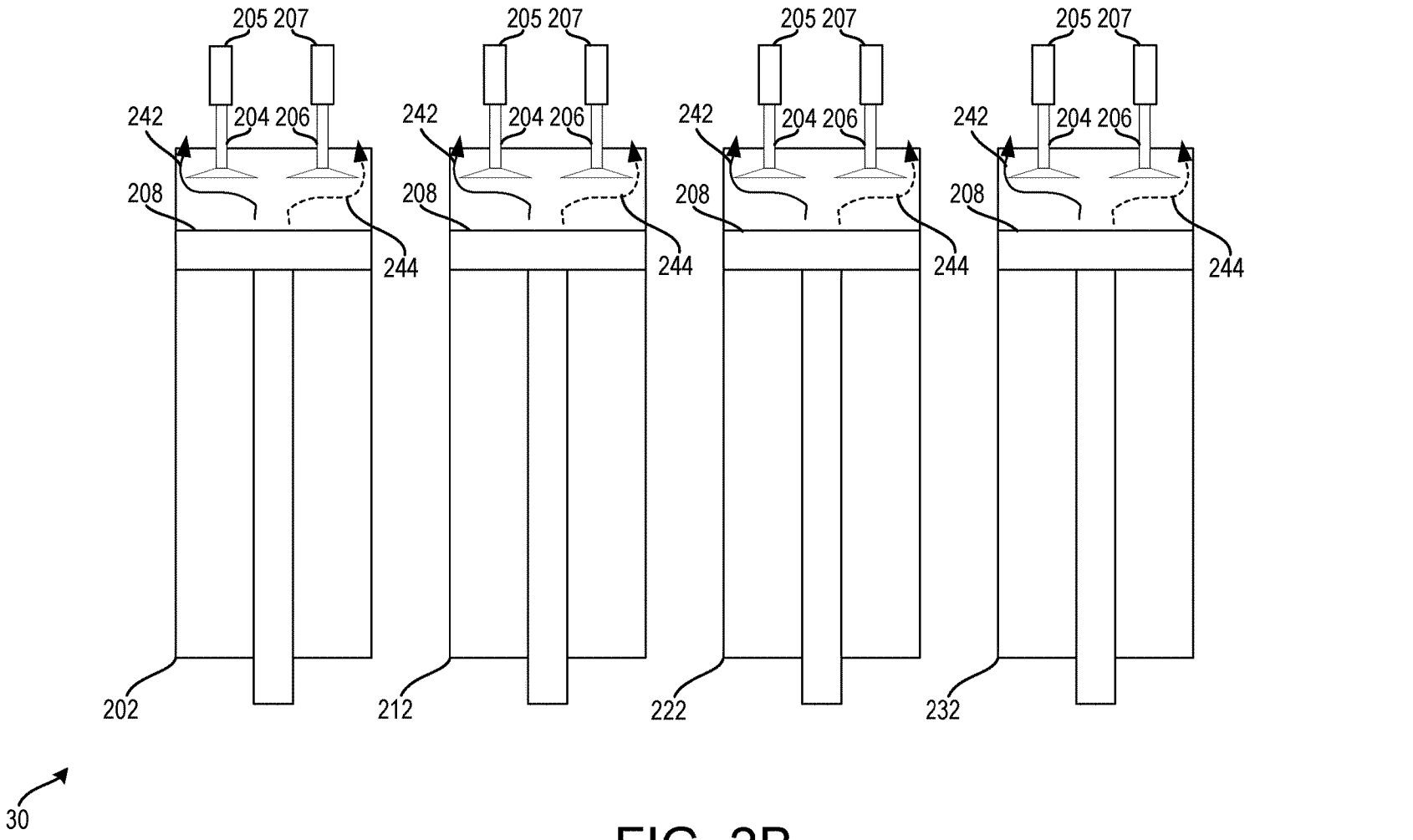
FIG. 2B illustrates a second example operation of the plurality of cylinders during an engine start request.
Figure 3A:
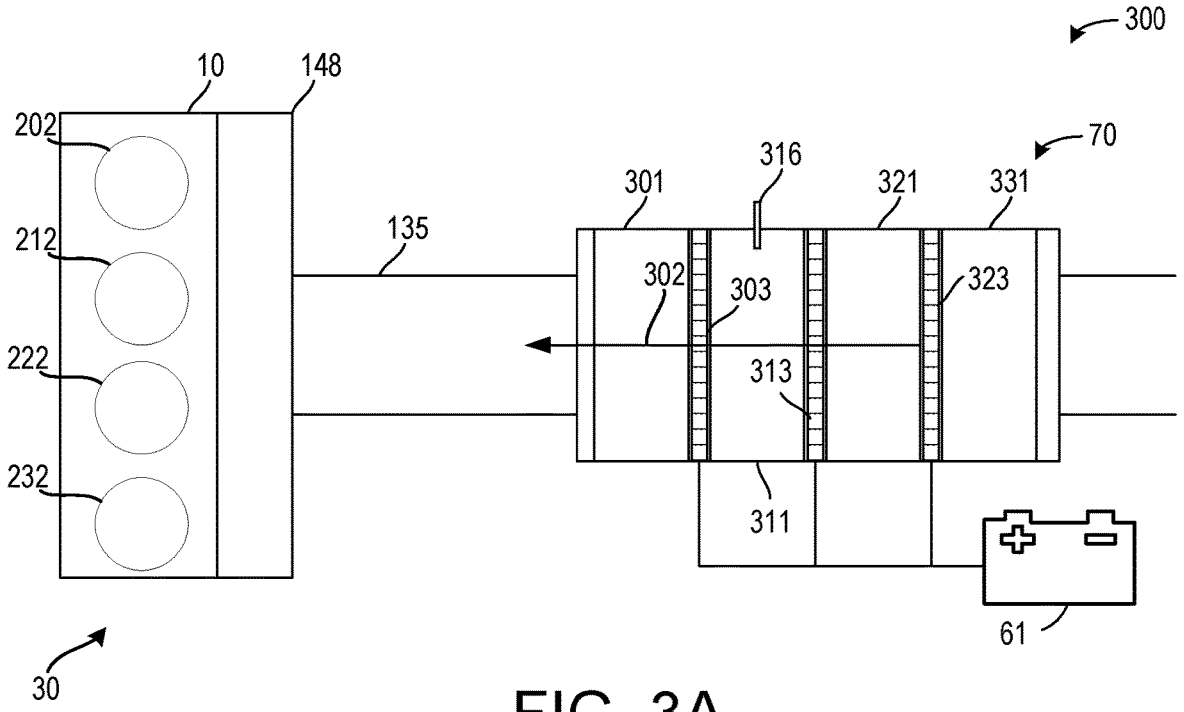
FIG. 3A illustrates an example of the aftertreatment device of FIG. 1 with gas flowing along a first direction during the engine start request.
Figure 3B:
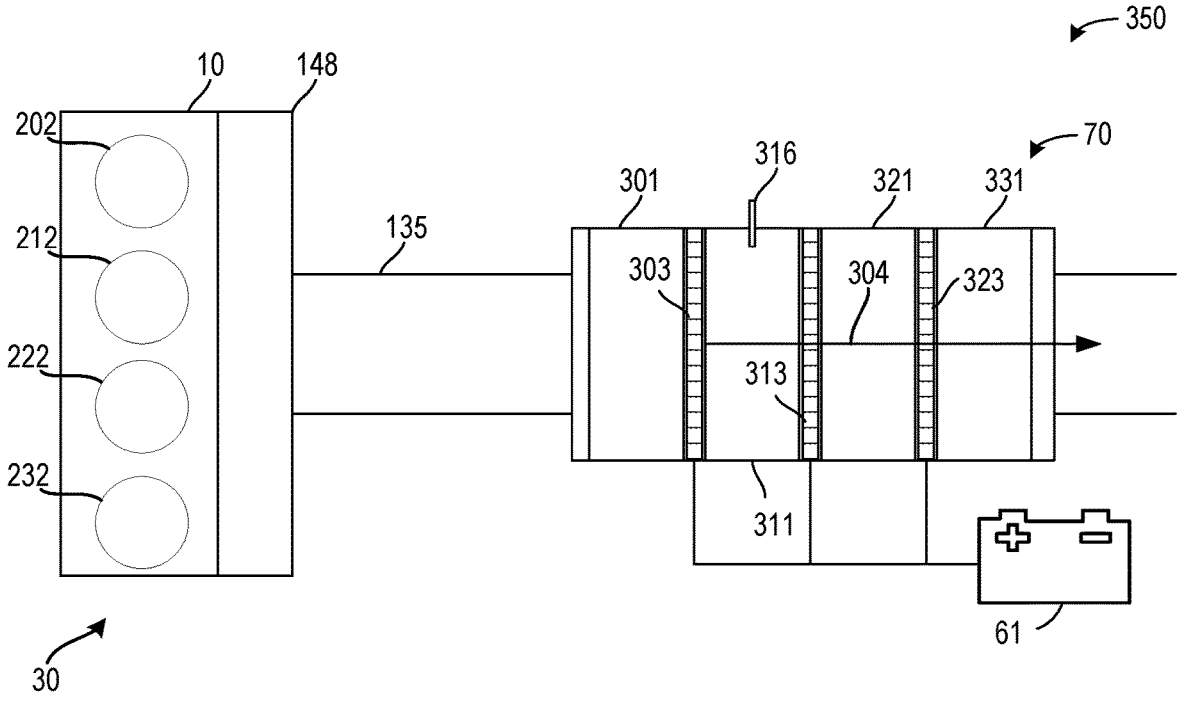
FIG. 3B illustrates the aftertreatment device of FIG. 3A with gas flowing along a second direction during the engine start request.
Figure 4A:
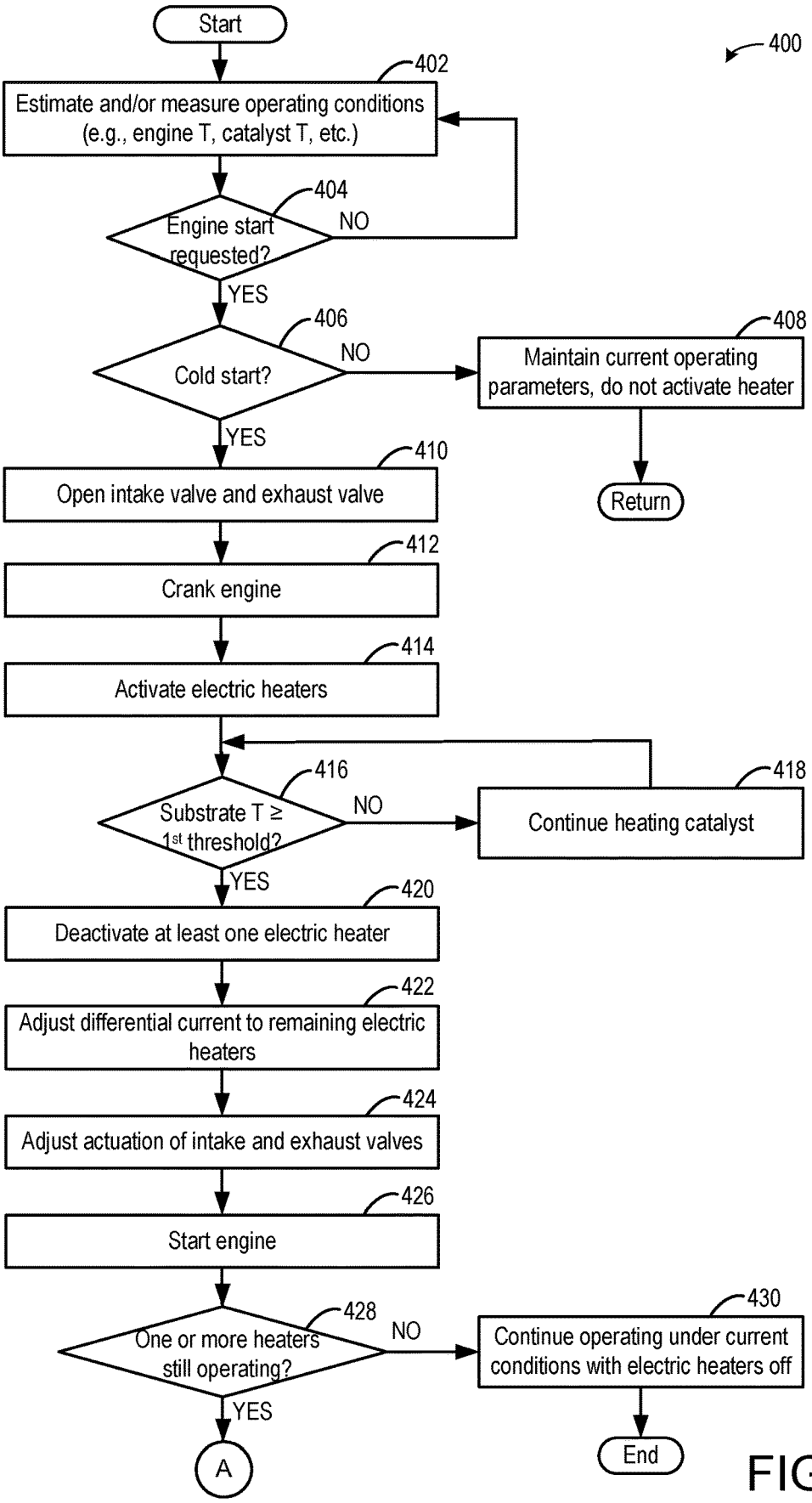
FIGS. 4A-4B illustrate a method for executing an engine start in response to an engine start request when a catalyst temperature is less than a threshold temperature.
Figure 4B:
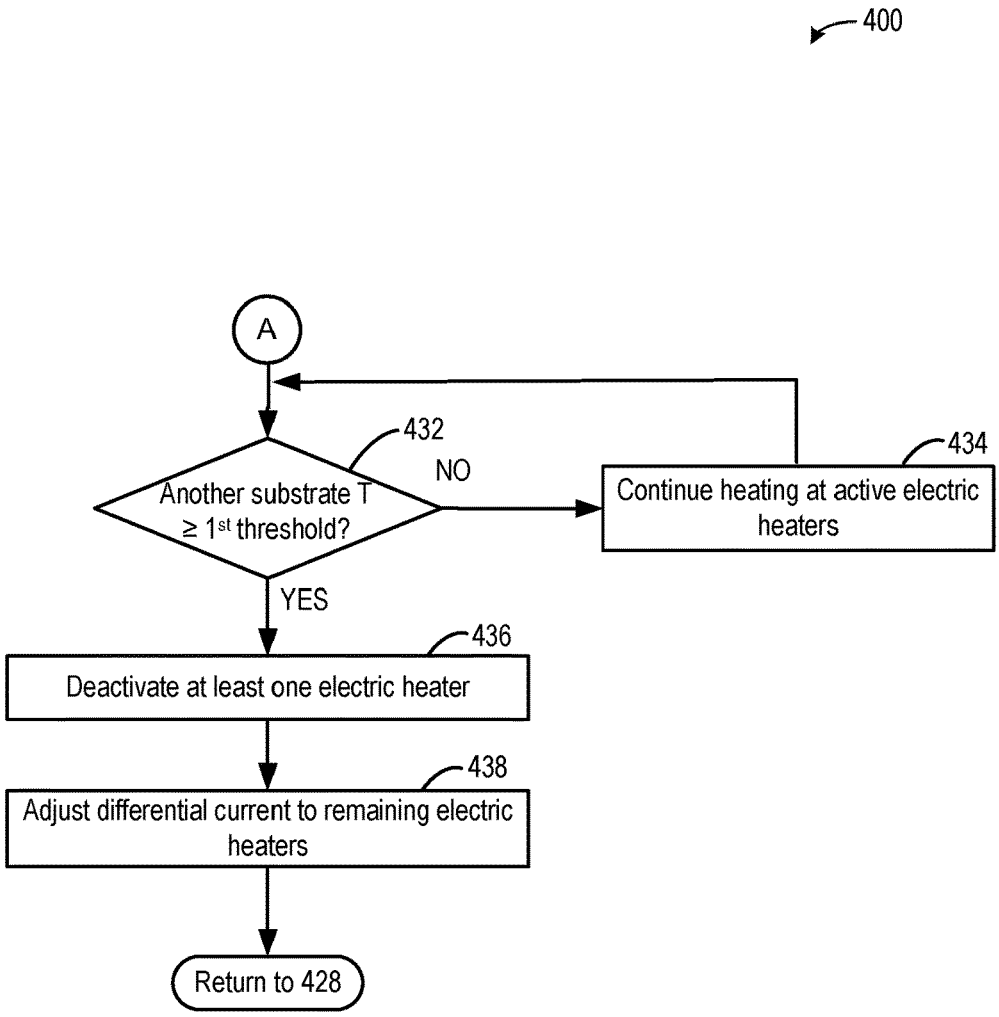
Figure 5:
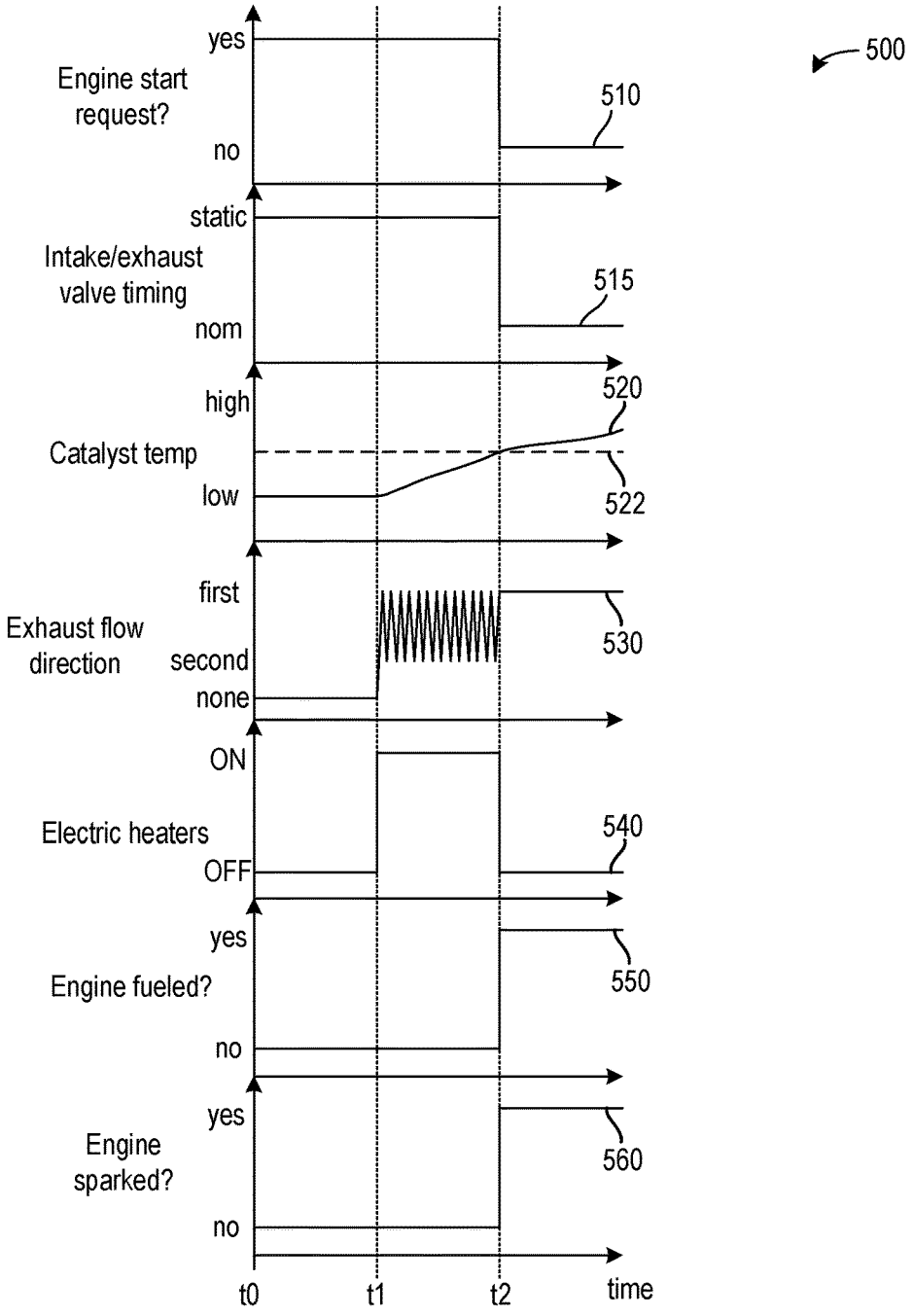
FIG. 5 illustrates an example engine operating sequence illustrating engine conditions in response to an engine start request when a catalyst temperature is less than a light-off temperature.
Figure 6:
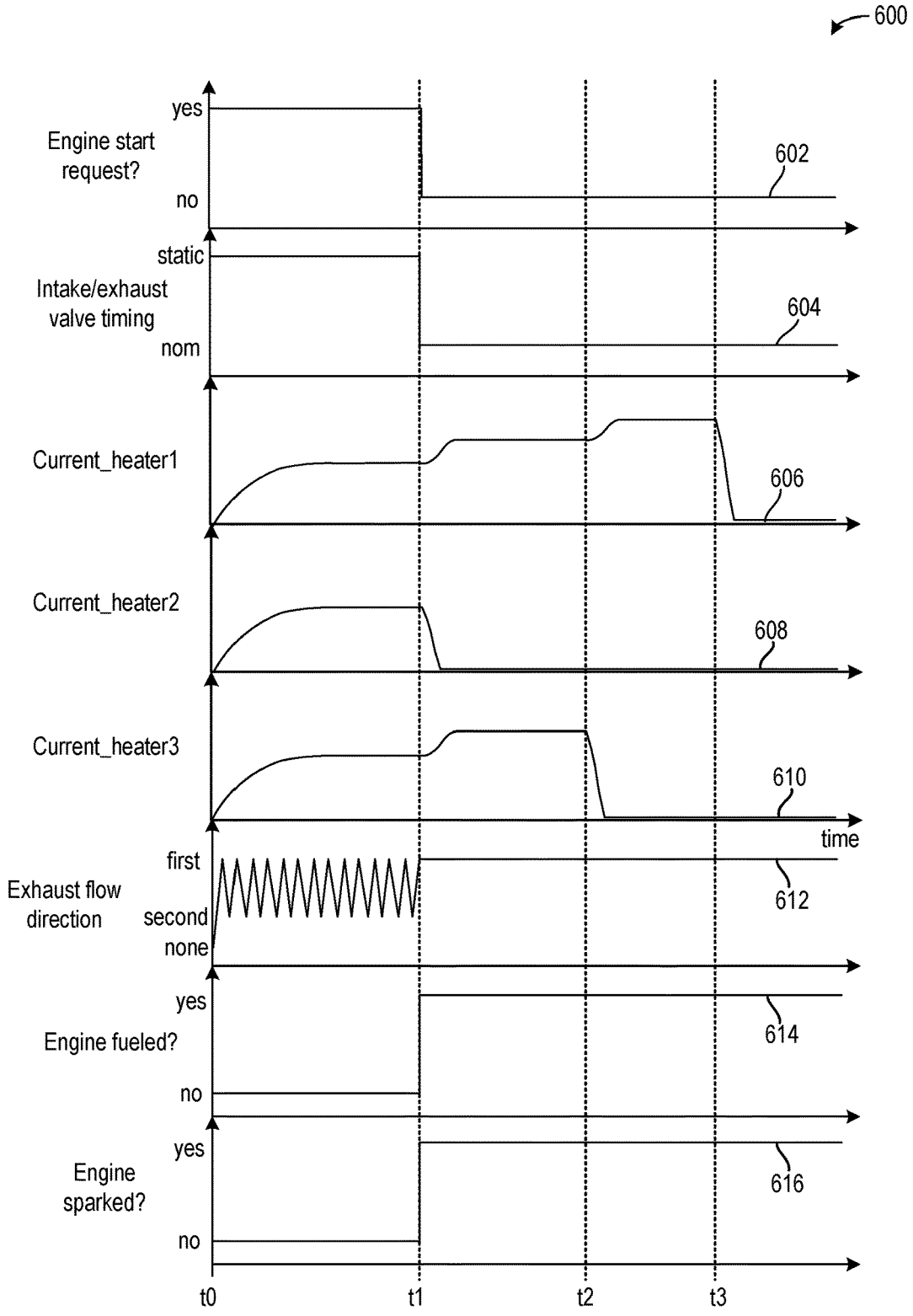
FIG. 6 illustrates example operations of a plurality of electric heaters coupled to a catalyst of an aftertreatment device.

The following description relates to systems and methods for an engine during a cold-start. In one example, the engine is an engine of a hybrid vehicle, as illustrated in FIG. 1. An exhaust system of the engine may comprise more than one electric heater coupled to a catalyst with more than one substrate. For example, the engine may have at least two electric heaters coupled to at least three catalyst substrates. The engine may be operated during certain conditions to pump gases back and forth through the catalyst and the electric heaters to heat the catalyst more quickly. To pump the gases, the engine may be cranked while unfueled. Intake and exhaust valves of the engine may be opened to reduce pumping losses while displacing gases in the intake and exhaust systems, as shown in FIGS. 2A and 2B. An example of oscillating gas flow through the heaters and the catalyst is illustrated in FIGS. 3A and 3B. A method for operating the engine in response to a start request during cold-start conditions is illustrated in FIGS. 4A-4B. FIG. 5 illustrates an example engine operating sequence illustrating engine conditions in response to an engine start request when a catalyst temperature is less than a light-off temperature. An example of how the electric heaters may be operated in response to catalyst temperature is depicted in FIG. 6.

FIGS. 3A-3B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Turning to the figures, FIG. 1 depicts an example of a cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 via a transmission 54, as further described below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutch 56 is engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 61 may be a traction battery that delivers electrical power to electric machine 52 to provide torque to vehicle wheels 55. In some embodiments, electric machine 52 may also be operated as a generator to provide electrical power to charge system battery 61, for example, during a braking operation. It will be appreciated that in other embodiments, including non-electric vehicle embodiments, system battery 61 may be a typical starting, lighting, ignition (SLI) battery coupled to an alternator 46.

Alternator 46 may be configured to charge system battery 61 using engine torque via crankshaft 140 during engine running. In addition, alternator 46 may power one or more electrical systems of the engine, such as one or more auxiliary systems, including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based on system usage requirements, including auxiliary system demands.

Cylinder 14 of engine 10 can receive intake air via a series of intake passages 142 and 144 and an intake manifold 146. Intake manifold 146 can communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from the engine, and exhaust turbine 176 may be optionally omitted. In still other examples, engine 10 may be provided with an electric supercharger (e.g., an "eBooster"), and compressor 174 may be driven by an electric motor.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

An exhaust manifold 148 can receive exhaust gases from other cylinders of engine 10 in addition to cylinder 14. An exhaust gas sensor 126 is shown coupled to exhaust manifold 148 upstream of an aftertreatment device 70. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO sensor. Aftertreatment device 70 may be a three-way catalyst, a NOx trap, various other emission control devices, or combinations thereof. In the example of FIG. 1, aftertreatment device 70 is a three-way catalyst.

In one example, aftertreatment device 70, may include a multi-substrate catalyst formed of more than one catalytic substrate. Each catalytic substrate is a section, e.g., a brick, of the three-way catalyst of aftertreatment device 70 in the example of FIG. 1. For example, each section of the multi-substrate catalyst may be formed of a material that catalyzes one of more chemical reactions, such as conversion of CO to $CO_2$, HCs to $H_2O$ and $CO_2$, etc. Furthermore, in some instances, one or more electric heaters 75, as shown in FIG. 1, may be coupled to the catalyst of aftertreatment device 70 to electrically heat the catalyst.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an intake actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. For example, valve actuators may be a cam actuation type and the intake and exhaust valve timing may be controlled concurrently, and any of a possibility of variable intake cam timing, variable exhaust cam timing, dual independent variable cam timing, or fixed cam timing may be used in conjunction with multiple cam profiles or oscillating cams. In some examples, the cam actuation system may be a single cam and may utilize one or more of cam profile switching (CPS), variable cam timing (VCT), variable valve timing (VVT), and/or variable valve lift (VVL) systems that may be operated by controller 12 to vary valve operation. In one example, the cam actuation system may include additional tappets coupling the intake/exhaust valves to a camshaft where the additional tappets are configured to selectively couple and decouple the valves to and from the camshaft. In this way, actuation of the intake/exhaust valves may be enabled independent of rotation of the camshaft. In yet other examples, a camless system may be used and the actuators 152, 154 may be electronically controlled. For example, the valves may be electro-pneumatic valves, electro-hydraulic valves, or electromagnetic valves.

Cylinder 14 can have a compression ratio, which is a ratio of volumes when piston 138 is at bottom dead center (BDC) to top dead center (TDC). In one example, the compression ratio is in the range of 9:1 to 10:1. However, in some examples, the compression ratio may be increased when different fuels are used. This may happen, for example, when higher octane fuels or fuels with a higher latent enthalpy of vaporization are used. The compression ratio may also be increased if direct injection is used due to its effect on engine knock.

Each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed and engine load, into a look-up table and output the corresponding MBT timing for the input engine operating conditions. In other examples, spark may be retarded from MBT, such as to expedite catalyst warm-up during engine start or to reduce an occurrence of engine knock.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and may be further configured to inject this fuel mixture directly into cylinder 14. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. Moreover, fuel characteristics of one or both fuel tanks may vary frequently, for example, due to day to day variations in tank refilling.

Controller 12, which may include a powertrain control module (PCM), is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 135; a profile ignition pickup signal (PIP) from a Hall effect sensor 120 (or other type) coupled to crankshaft 140; a throttle position signal (TP) from a throttle position sensor; signal UEGO from exhaust gas sensor 126, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of aftertreatment device 70 based on the signal received from temperature sensor 158.

Controller 12 receives signals from the various sensors of FIG. 1, processes the received signals, and employs the various actuators of FIG. 1 (e.g., fuel injector 166 and spark plug 192) to adjust engine operation based on the received signals and instructions stored on a memory of the controller. For example, the controller may receive a request for slowing of the vehicle based on input from the accelerator pedal (e.g., the accelerator pedal is released). In response to the request, the controller may command fuel injection at one or more cylinders to stop, thereby reducing fuel consumption during a period where torque is not demanded.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders, referred to in the following description as a plurality of cylinders 30, as depicted in FIGS. 2A-3B. Further, each of these cylinders can include some or all of the various components described and depicted by FIG. 1 with reference to cylinder 14.

During engine cold starts, an engine, such as engine 10 of FIG. 1, may be used to increase catalyst conversion efficiency. When catalyst substrate temperature is below a light-off temperature, catalytic conversion efficiency is very low. A period of time for heating the catalyst to its light-off temperature may be undesirably slow, resulting in a period of low catalyst conversion efficiency during which untreated combustion byproducts and hydrocarbons may be released to the atmosphere. Heating of the catalyst to at least the light-off temperature may be expedited by oscillating gases across heating elements and catalyst substrates via the engine system when the catalyst is configured as a multi-substrate catalyst.

Prior to fuel injection, the engine may be used as a pump to circulate gases in an oscillated flow pattern within an intake system, e.g., intake passages 142, 144, and the intake manifold 146 of FIG. 1, and an exhaust system, e.g., the exhaust manifold 148 and the aftertreatment device 70 of FIG. 1. Fuel injection may be halted and intake valves and exhaust valves of the cylinders are opened. The crankshaft may be rotated by an electric device, pumping the pistons within the cylinders, which facilitates flow of intake gases and exhaust gases into or out of the cylinders, depending on the crankshaft phase. The oscillating intake gases and exhaust gases circulate back and forth through the catalyst substrates and electric heaters coupled thereto to heat the catalyst. The gases are heated as they pass over the electric heaters, then heat up the catalyst as the warm gases pass over the catalyst substrates.

Turning now to FIGS. 2A and 2B, a first example 200 and a second example 250 of operation of the plurality of cylinders 30 during a cold start are shown, respectively. As such, the plurality of cylinders 30 may be used in engine 10 of FIG. 1. Components previously introduced are similarly numbered in FIGS. 2A-2B and subsequent figures. Intake valve 204, exhaust valve 206, piston 208, intake actuator 205, and exhaust actuator 207 are similarly configured as the intake valve 150, exhaust valve 156, piston 138, intake actuator 152, and exhaust actuator 154 depicted in FIG. 1, respectively. The plurality of cylinders 30 is depicted with four cylinders but it will be appreciated that more than four or fewer than four cylinders may be used without departing from the scope of the present disclosure. Furthermore, while each of the plurality of cylinder 30 is shown in the same phase, e.g., at a same point of a same stroke, in FIGS. 2A-2B, it will be appreciated that this is for illustrative purposes. The plurality of cylinders 30 may have varied phasing such that each cylinder may be phased offset to one another. The plurality of cylinders 30 includes a first cylinder 202, a second cylinder 212, a third cylinder 222, and a fourth cylinder 232. In the examples of FIGS. 2A-2B, each of the plurality of cylinders 30 is identical in configuration.

Each cylinder of the plurality of cylinders 30 has an intake valve 204, an exhaust valve 206, and a piston 208. The intake valve 204 may be actuated via an intake actuator 205 and the exhaust valve 206 may be actuated via an exhaust actuator 207. In one example, the intake actuator 205 and the exhaust actuator 207 may be any of the valve actuators described above with reference to FIG. 1 that may adjust positions of the intake and exhaust valve to fully closed positions, fully open positions (e.g., as illustrated in FIGS. 2A-2B), and positions therebetween.

In one example, the intake valve 204 and the exhaust valve 206 may be adjusted to the fully open positions concurrently during an engine cold start. For example, in response to a start-request occurring while an engine temperature is low, e.g., corresponding to a cold start, the controller 12 may command fueling to the plurality of cylinders 30 to be blocked. The controller 12 may then signal to a starter motor or other electric device to crank the plurality of cylinders 30 such that intake gases 242 and exhaust gases 244 may flow into the plurality of cylinders 30 or flow out of the plurality of cylinders 30, depending on a crankshaft phase. More specifically, the piston 208 of each cylinder may pump the intake gases 242 and the exhaust gases 244 in and out of the combustion chambers of the plurality of cylinders 30, resulting in an oscillating motion of intake gases 242 in an intake system of the engine, e.g., the engine intake manifold 146 of FIG. 1, and exhaust gases 244 in an exhaust system of the engine, e.g., the engine exhaust manifold 148 of FIG. 1

The crankshaft, e.g., the crankshaft 140 of FIG. 1, may be rotated at a predetermined speed, such as 1250 rpm, without fuel injection, spark ignition, or combustion at the plurality of cylinders 30. The intake gases 242 may therefore initially be fresh air and the exhaust gases 244 may initially be a mixture of air and residual combusted fuel (e.g., from a previous drive cycle). By maintaining the intake valve 204 and the exhaust valve 206 open while operating the crankshaft, pumping losses are minimized. Furthermore, the oscillating flow of the exhaust gases 244 through the exhaust system promotes rapid heating of an aftertreatment device of the exhaust system, explained further below with reference to FIGS. 3A-3B.

For example, the piston 208 of each cylinder of the plurality of cylinders 30 is shown at bottom dead center (BDC) in the first example 200 of FIG. 2A. The first example 200 may therefore correspond to an end of an intake stroke or an expansion stroke of a four-stroke cylinder cycle, as driven by rotation of the crankshaft. As the piston 208 moves down during the intake stroke or expansion stroke, the intake gases 242 and the exhaust gases 244, as shown in FIG. 2A, flow into each cylinder through the open intake valve 204 and the open exhaust valve 206 from the intake system and the exhaust system, respectively. Although the intake gases 242 and the exhaust gases 244 are described as oscillating through the intake system and exhaust system, respectively, it will be appreciated that the description is for illustrative purposes and mixing of the gases within the cylinders may occur such that the intake gases do not remain distinct from the exhaust gases during unfueled engine cranking.

During a compression or an exhaust stroke of the cylinder cycle, the piston 208 moves up to top dead center (TDC), pushing the intake gases 242 and the exhaust gases 244 out of the plurality of cylinders 30. The piston 208 of each cylinder of the plurality of cylinders 30 is depicted at TDC in FIG. 2B and may correspond to an end of the compression stroke or exhaust stroke.

As the piston 208 moves up to TDC during the compression stroke or exhaust stroke, the intake gases 242 and the exhaust gases 244, as shown in FIG. 2B, flow out of each cylinder through the open intake valve 204 and the open exhaust valve 206 to the intake system and the exhaust system.

In addition to oscillating air/gas flow through cylinders of an engine with each of the intake valve and exhaust valve opened, one or more electric heaters may be arranged in the aftertreatment housing, as illustrated in the embodiment of FIGS. 3A and 3B, to expedite catalyst light-off. As the engine cranks during a cold start, exhaust gases may flow back and forth across the catalyst, which may be formed of three or more substrates. As such, exhaust gases may flow across the electric heater as it oscillates across the substrates, thereby enabling the catalyst to quickly reach the light-off temperature which may decrease emissions and fuel consumption.

Turning now to FIGS. 3A and 3B, they show embodiments 300 and 350 illustrating exhaust gas flow through the aftertreatment device 70 of the engine 10 (e.g., of FIG. 1) during a cold start, respectively. The aftertreatment device 70 may include a multi-substrate catalyst. As illustrated, exhaust gas flows in a first direction 302 in the aftertreatment device 70 in the embodiment 300 and in a second direction 304, opposite the first direction 302, in the embodiment 350.

The aftertreatment device 70 comprises two or more electric heaters, which may be examples of the electric heaters 75 of FIG. 1, interspaced between three or more catalytic substrates. Splitting the catalytic substrate into multiple smaller substrates and sandwiching electric heaters therebetween allows for rapid heating of catalytic substrates to the light-off temperature, even during engine cold start. In one example, the light-off temperature may be greater than 200° C. In one example, the light-off temperature may be 300° C. Catalytic substrates may be heated by convection from oscillating heated air and conduction from direct contact with electric heaters.

As illustrated in FIGS. 3A and 3B, a first electric heater 303 is sandwiched between a first catalytic substrate 301 and a second catalytic substrate 311, a second electric heater 313 is sandwiched between second catalytic substrate 311 and a third catalytic substrate 321, and a third electric heater 323 is sandwiched between third catalytic substrate 321 and a fourth catalytic substrate 331. First catalytic substrate 301 and fourth catalytic substrate 331 may be sized for engine peak power and load conditions where exhaust flow is high. For example, a size of a substrate may be determined based on a volume of the substrate which may depend on a displacement of the engine, e.g., substrate volume may increase with an increase in displacement. The substrate volume may determine a front surface area and/or a hydraulic diameter of the substrate which affects a loss of pressure across the substrate. Thus, first catalytic substrate and fourth catalytic substrate 331 may be configured with a suitable volume to accommodate high flow rates and a minimal drop in pressure. In another example, inner flow passages and/or pores of the first and fourth catalytic substrates may be larger than those of second and third catalytic substrates 311, 321, thus allowing faster flow therethrough. Heat transfer from the electric heaters to first and fourth catalytic substrates 301, 331 may be slower than those of second and third catalytic substrates 311, 321. First and fourth catalytic substrates 301, 331 may be formed of, for example, a synthetic ceramic material with a low thermal expansion coefficient.

Second catalytic substrate 311 and third catalytic substrate 321 are configured in size and wash coat for engine cold start, with thin walls and low thermal mass, allowing for more rapid heating compared to first catalytic substrate 301 and fourth catalytic substrate 331. For example, second and third catalytic substrates 311 and 321 may be smaller in one or more dimensions, such as a thickness of the substrate with respect to the direction of flow, thereby reduced in mass compared to first and fourth catalytic substrates 301, 331. The thin walls of second and third catalytic substrates 311, 321, may be impregnated with metals such as platinum, rhodium, palladium, etc., and wash coated with a material such as $\gamma$-$Al_2O_3$, for example.

In one example, a temperature sensor 316 may be coupled to second catalytic substrate 311 to measure substrate temperature. However, in other examples, temperature sensor 316 may instead be coupled to third catalytic substrate 321. Since the second and third catalytic substrates 311 and 321 are heated twice per cycle as opposed to the first and fourth catalytic substrates 301 and 331 heated once per cycle, coupling temperature sensor 316 to either the second or third catalytic substrates may measure the hottest possible catalyst temperature. Furthermore, while only one temperature sensor is depicted coupled to the aftertreatment device 70, other examples may include more than one temperature sensor coupled to more than one catalytic substrate. For example, a temperature at each of first, second, third, and fourth catalytic substrates 301, 311, 321, 331 may be monitored by a temperature sensor. The temperature sensor 316 may be any of a variety of sensor types, such as a high-temperature infrared sensor.

First, second, and third electric heaters 303, 313, and 323 may each have a circular geometry to match a shape of the aftertreatment device 70 and may be powered by a common battery source, e.g., battery 61 of FIG. 3A. However, other geometries are possible, based on a geometry of the aftertreatment device 70. Furthermore, in another example, first, second, and third electric heaters 303, 313, and 323 may be powered by independent batteries and/or independently operated. When activated to elevate a temperature of the aftertreatment device 70, first, second, and third electric heaters 303, 313, and 323 may be heated to a preset temperature (e.g., 1200° C.).

The oscillating flow of the gases through the exhaust system promotes rapid heating of the aftertreatment device 70 of the exhaust system. For example, during intake and expansion strokes, the pistons of each of the plurality of cylinders 30 move from TDC to BDC and exhaust gases flow in the first direction 302 in the embodiment 300. Gases flow from the exhaust system, downstream of the aftertreatment device 70 (with respect to exhaust gas flow during fueled engine operation), through fourth catalytic substrate 331 and over third electric heater 323, which heats the gases to a temperature above the light-off temperature. Air may be drawn into the exhaust system through a tailpipe of the exhaust system as gases flow in the first direction 302. Heated gases continue to flow in the first direction 302, sequentially heating third catalytic substrate 321, second catalytic substrate 311, and first catalytic substrate 301, as the gases flow through. Furthermore, as the gases flow sequentially through third electric heater 323, second electric heater 313, and first electric heater 303, gas temperature increases. As an example, the electric heaters may be heated to 1200° C. which may heat the gases to 800° C. as the gases pass therethrough. When the gas flow is directed along the first direction 302, fourth catalytic substrate 331 may not be heated.

During compression and exhaust strokes, the pistons of each of the plurality of cylinders 30 move from BDC to TDC and exhaust gases flow in the second direction 304 in the embodiment 350. Gases are pumped by the cylinders through the exhaust manifold 148 and exhaust passage 135. Gases then flow through first catalytic substrate 301 and over first electric heater 303, which heats the gases to a temperature above the light-off temperature. Heated gases continue to flow in the second direction 304, sequentially heating second catalytic substrate 311, third catalytic substrate 321, and fourth catalytic substrate 331 as the gases flows through.

Furthermore, as the gases flow sequentially through first electric heater 303, second electric heater 313, and third electric heater 323, gas temperature increases. As an example, the electric heaters may be heated to 1200° C. which may heat the gases to 800° C. as the gases pass therethrough. When the gas flow is directed along the second direction 304, the first catalytic substrate 301 may not be heated.

Due to the oscillation of warm gases, second and third catalytic substrates 311 and 321 are heated twice during each engine cycle for fast light-off. First and fourth catalytic substrates 301 and 331 are heated once per engine cycle, and are prepared for peak power and load conditions. As a result, second and third catalytic substrates 311, 321 are heated faster and to a higher temperature than first and fourth catalytic substrates 301, 331. By enabling faster heating at inner catalytic substrates of the aftertreatment device 70 (e.g., at second and third catalytic substrates 311, 321), catalyst light-off is expedited while maintaining a flow rate due to the thin substrate walls embedded with materials configured for fast light-off, such as catalytic metals, a wash coat, etc. At outer catalytic substrates of the aftertreatment device, e.g., at first and fourth catalytic substrates 301, 331, high flow rates therethrough during engine operation is enabled by incorporating catalytic substrates of suitable volumes corresponding to expected maximum exhaust flows and engine displacement.

By dividing the catalyst into four individual substrates separated by electric heaters, each substrate has a smaller mass than a conventional catalyst (e.g., a catalyst with a single substrate block), allowing faster heating of each substrate. Heat transfer is further increased by the sandwiching of the electric heaters between the catalytic substrates. In addition, by configuring the electric heaters to be separate from the catalytic substrates, the electric heaters may be easily installed and removed.

Furthermore, in some examples, operation of the electric heaters may be leveraged to provide both expedited heating and efficient energy consumption. For example, in some instances a temperature sensor may be coupled to each catalytic substrate of the aftertreatment device. As gas, e.g., air and residual exhaust gases, is pumped back and forth across the aftertreatment device with the electric heaters activated and set to heat to a threshold temperature, such as 1200° C., at least one of the inner catalytic substrates may reach the light-off temperature first. Upon detection of the at least one catalytic substrates reaching the light-off temperature, the engine may be fueled and sparked. As well, one or more of the electric heaters may be deactivated accordingly. For example, if second and third catalytic substrates 311, 321 of FIGS. 3A-3B are determined to reach the light-off temperature while first and fourth catalytic substrates 301, 331 are still cooler than the light-off temperature, second electric heater 313 may be deactivated. Power from an energy source, such as the battery 61, may be redistributed to first and third electric heaters 303, 323 to increase a heating rate provided by first and third electric heaters 303, 323.

As another example, second catalytic substrate 311 may reach the light-off temperature ahead of the other substrates and engine start may be commanded. Third catalytic substrate 321 may be determined be within a close margin of the light-off temperature, such as 15° C. Heat transfer from second catalytic substrate 311 and from hot exhaust gases may be anticipated to be fast and as such, second electric heater 313 may be deactivated. Thus, operation of the electric heaters may be strategically adjusted to minimum energy usage to the heat the aftertreatment device.

As the gases flow back and forth, the catalytic substrates may reach the light-off temperature rapidly, such as within 20 seconds or less. In one example, the catalysts are configured to reduce hydrocarbons, carbon monoxide, and $NO_x$ emissions. In some examples, additionally or alternatively, the catalysts may also include a particulate filter to remove particulate matter from the exhaust gases prior to atmospheric release. Once the catalytic substrates are heated to at least the light-off temperature, the engine can start and emissions can be converted with high efficiency, thereby decreasing emissions and fuel consumption.

Turning now to FIGS. 4A and 4B, a method 400 is shown for executing an engine start in response to an engine start request when a catalyst temperature is less than a first threshold temperature. Method 400 may be implemented at an engine, such as the engine 10 of FIG. 1, adapted with an aftertreatment device such as the aftertreatment device 70 of FIGS. 1 and 3A-3B. The aftertreatment device may be configured with three or more catalytic substrates separated by two or more electric heaters, with an electric heater sandwiched between each of the catalytic substrates. Instructions for carrying out method 400 may be executed by a controller, such as controller 12 of FIG. 1, based on instructions stored on a memory of the controller and in conjunction with signals received from sensors of the engine system, such as the sensors described above with reference to FIG. 1. The controller may employ engine actuators of the engine system to adjust engine operation, according to the methods described below.

The method 400 begins at 402 of FIG. 4A, which includes determining, estimating, and/or measuring current operating conditions. For example, controller 12 of FIG. 1 may infer an engine temperature based on an ECT measured by a temperature sensor, such as the temperature sensor 116 of FIG. 1, a catalyst temperature at the aftertreatment device may be detected by one or more temperature sensors, such as temperature sensor 316 of FIGS. 3A and 3B, and air flow through an intake system and an exhaust system may be monitored via mass flow sensors, such as the MAF sensor 122 of FIG. 1. In one example, a single temperature sensor may be coupled to an inner catalytic substrate of the aftertreatment device, e.g., as shown in FIGS. 3A-3B, and a temperature of the other catalytic substrates may be inferred based on signals from the single temperature sensor, mass air flow through the exhaust temperature, a temperature sensor measuring ambient temperature, etc. In another example, each catalytic substrate may be coupled to a temperature sensor. Also, ambient conditions including ambient temperature may be estimated.

The method 400 proceeds to 404, which includes determining if an engine start is requested. The engine start may be requested in response to an ignition key being turned, a button being depressed in a key fob, indication via a smart device (such as a phone), and the like. If the engine start is not requested, then the method 400 returns to 402 to continue monitoring the operating conditions.

If the engine start is requested, the method 400 proceeds to 406, which includes determining if a cold start is indicated. In one example, cold start may be indicated when an engine temperature is lower than threshold temperature such as a minimum temperature at which a viscosity of an engine lubricant is reduced to sufficiently lubricant engine components. As another example, the threshold temperature of the engine may be a minimum temperature for optimal power output. In another example, the cold start may be indicated when the catalyst temperature is below a light-off temperature. In some instances, the cold start is confirmed when the catalyst temperature is beyond (e.g., lower than) a margin of the light-off temperature. The margin may be, as an example, a temperature range of up to 20° C. below the light-off temperature. If the engine was recently operated and shut down for a short period of time, the catalyst may cool to a temperature within the margin and may be rapidly heated to the light-off temperature upon engine start. The controller may determine that less energy may be consumed by allowing the aftertreatment device to be rapidly heated to the light-off temperature via heating from exhaust gases rather than activating the electric heaters and may therefore command the engine start to proceed without electric heating. However, if the catalyst temperature cools to beyond the margin, expedited heating may be demanded.

If the cold start is not indicated, then the method 400 proceeds to 408, to maintain the current operating parameters without activating the heater.

If the cold start is indicated, then the method 400 proceeds to 410, which includes opening the intake valves and exhaust valves, e.g., intake valve 204 and exhaust valve 206 of FIGS. 2A-2B. For example, the controller may command an intake valve actuator and an exhaust valve actuator to adjust the intake valve and the exhaust valve, respectively, to fully open positions. By opening the intake and the exhaust valves, pumping losses in the engine may be reduced when the engine is cranked.

The method 400 proceeds to 412, which includes cranking the engine. In one example, the engine may be cranked to a speed of 1250 rpm. The engine may be cranked via electrical energy supplied from a battery to a starter motor or other device configured to rotate a crankshaft of the engine. With the intake and exhaust valves open, pumping losses are reduced as gases in the intake system and the exhaust system are displaced via the engine. Said another way, the engine is operated as a pump, thereby oscillating intake gases in the intake system and exhaust gases in the exhaust system. In one example, the intake gases and the exhaust gases are ambient air which may be mixed with residual combustion gases from a previous drive cycle back-filled in the intake and exhaust systems.

The method 400 proceeds to 414, which includes activating electric heaters which may occur as engine cranking begins. The electric heaters may be heated to a threshold electric heater temperature. In one example, the threshold electric heater temperature is a fixed temperature, wherein the fixed temperature is 1200° C. Furthermore, as described above, activation of the electric heaters may be adjusted based on the temperature of the catalyst. When at least one catalytic substrate of the aftertreatment device is detected to reach the light-off temperature, at least one of the electric heaters in direct contact with the catalytic substrate may be deactivated. However, as each of the electric heaters is sandwiched between two of the catalytic substrates, the deactivation may also depend on a temperature of an adjacent catalytic substrate where the temperature of the adjacent catalytic substrate is not yet at the light-off temperature. If the temperature of the adjacent catalytic substrate is approaching the light-off temperature, an electric heater arranged therebetween may be deactivated, and electrical energy used to power that electric heater may be redirected to the remaining, still-active electric heaters, allowing the still-active electric heaters to continue heating the air and catalytic substrates at a faster rate. Alternatively, distribution of electric power may remain unchanged and energy may be saved by deactivating the electric heater.

The method 400 proceeds to 416, which may include determining if a temperature of at least one catalytic substrate is greater than or equal to a first threshold temperature. In one example, the first threshold temperature is equal to the light-off temperature of the catalyst. As an example, the light-off temperature may be 300° C. During oscillation of gases (e.g., circulation of gases back and forth relative to a direction of gas flow through the exhaust system) across the aftertreatment device, inner catalytic substrates (e.g., second and third catalytic substrates 311, 321 of FIGS. 3A and 3B) may be heated at twice of a rate of outer catalytic substrates (e.g., first and fourth catalytic substrates 301, 331 of FIGS. 3A and 3B) of the aftertreatment device. At least one of the inner catalytic substrates may therefore reach the light-off temperature earlier than the remaining catalytic substrates. The temperature at the catalytic substrate that reaches the light-off temperature first may be used to confirm the catalyst temperature. However, in other examples, confirming that the catalyst temperature reaches the first threshold temperature may be delayed until all the inner catalytic substrates or more than one of the catalytic substrates of the catalyst reaches the light-off temperature.

If the temperature at one or more of the catalytic substrates is not greater than or equal to the first threshold temperature, in other words, if the catalyst temperature is less than the first threshold temperature, then the method 400 proceeds to 418 and continues to heat the catalyst via the activated electric heaters. The method 400 may further include continually monitoring the catalyst temperature based on feedback from the temperature sensor at the catalyst.

If the temperature at one or more of the catalytic substrates is greater than or equal to the first threshold, the method 400 proceeds to 420, to deactivate at least one electric heater in contact with the one or more catalytic substrates that reach the first threshold. For example, if one of the inner catalytic substrates reaches the light-off temperature, one of two electric heaters in direct contact with the lit-off inner catalytic substrate may be selected for deactivation. The deactivated electric heater may be chosen based on a temperature differential between the lit-off catalytic substrate and a catalytic substrate adjacent to the lit-off catalytic substrate, e.g., a catalytic substrate separated from the lit-off catalytic only by one of the electric heaters. The electric heater between the lit-off catalytic substrate and an adjacent catalytic substrate that is cooler than the lit-off catalytic substrate by a greater margin may be maintained on and the other electric heater may be deactivated. Upon deactivating the at least one electric heater, a differential current may be directed to the remaining, still-active electric heaters at 422 to increase heating at the catalytic substrates that have not yet reached the light-off temperature. In some examples, a catalytic substrate anticipated to reach the light-off temperature last may receive more of the redirected power.

For example, of the outer catalytic substrates, a first, most upstream (e.g., relative to exhaust gas flow during fueled engine operation) catalytic substrate, such as first catalytic substrate 301 of FIGS. 3A and 3B, may not heat as quickly as the inner catalytic substrates during unfueled operation of the engine to pump air back and forth across the aftertreatment device. When at least one of the two inner catalytic substrates reaches the light-off temperature and the engine is started, gas may flow in the second direction 304 shown in FIG. 3B. Initially after engine startup, exhaust gases may be relatively cool compared to the temperature of the inner catalytic substrates and the first, upstream catalytic substrate may only be heated by heat conduction from an adjacent electric heater and not convectively heated by exhaust gases that are heated by the electric heaters due to the direction of gas flow (e.g., in the second direction and not oscillating). As such, increased power may be directed to the electric heater in contact with the first catalytic substrate to expedite heating at the first catalytic substrate.

The method 400 proceeds to 424, which includes adjusting actuation of intake and exhaust valves. For example, a timing of opening and closing of the valves may be adjusted to a nominal timing which may be a timing used during engine operation when the engine is fueled and generating torque and opening and closing of the intake and exhaust valves is driven by rotation of the camshaft. At 426, the method 400 includes starting the engine. Starting the engine may include injecting fuel and providing spark ignition at the cylinders. Rotation of the crankshaft by the starter motor or other electrical device may be terminated and crankshaft rotation may instead be driven by energy from fuel and air combustion at the cylinders.

At 428, the method 400 includes confirming if one or more of the electric heaters is still actively heating the catalyst. For example, if engine start was initiated based on less than all of the catalytic substrates reaching the light-off temperature (e.g., one, two, or three substrates of first, second, third, and fourth catalytic substrates 301, 311, 321, 331 of FIGS. 3A-3B) at least one electric heater may still be operating. If none of the electric heaters is confirmed to be active, the method 400 proceeds to 430 to continue engine operation under the current conditions and with the electric heaters deactivated. The method 400 ends.

However, if at least one of the electric heaters is still operating, the method 400 continues to 432 of FIG. 4B to determine if another catalytic substrate temperature has reached the first threshold (e.g., the light-off temperature). If no additional catalytic substrates have reached the first threshold, the method 400 proceeds to 434 to continue heating the catalyst at the electric heaters that are still operating. If at least one catalytic substrate is confirmed to reach the first threshold, the method 400 continues to 436 to deactivate at least one electric heater in direct contact with the catalytic substrate. The electric heater may be selected as described above if the lit-off catalytic substrate is in contact with more than one active electric heater.

At 438, the method 400 includes directing a differential current from the deactivated electric heater to any remaining electric heaters that are still operating. However, if no electric heaters remain active, no current is drawn from an energy storage device used to power the electric heaters, such as a battery. The method 400 returns to 428 of FIG. 4A to determine if any of the electric heaters are still operating.

Turning now to FIG. 5, it shows a first graph 500 illustrating an example engine operating sequence of an engine start request when a catalyst temperature is less than a light-off temperature. The engine operating sequence may be implemented in an engine system including an engine such as engine 10 of FIG. 1. An exhaust system of the engine may include an aftertreatment device such as the aftertreatment device 70 depicted in FIGS. 1, 3A, and 3B. The first graph 500 includes a plot 510, illustrating if an engine start is requested, a plot 515 indicating a timing of intake and exhaust valves at the engine cylinders, a plot 520, illustrating a catalyst temperature, a plot 530, illustrating an exhaust gas flow direction, a plot 540, illustrating a status of two or more electric heaters arranged sequentially in the aftertreatment device and spaced apart from one another by catalyst substrates, a plot 550, illustrating fueling at an engine of the engine system, and a plot 560, illustrating if the engine is sparked. Time increases along the x-axis from a left to a right side of the figure.

Plots 510, 550, and 560 vary between yes and no along the y-axis. For plot 515, the valve timing is adjusted between a nominal timing, which may be a timing used when the engine is fueled and sparked to generate torque, and a static timing. Opening and closing of the intake valves and exhaust valves may be staggered during the nominal timing. During the static timing, the intake valves and exhaust valves may be opened at the same time and maintained open until commanded to return to the nominal timing. For plot 520, catalyst temperature increases upwards along the y-axis. In addition, plot 520 includes a threshold 522 which may be a light-off temperature of the catalyst. In one example, the light-off temperature may be 300° C. For plot 530, the exhaust flow direction varies between no flow, a first direction, and a second direction. For example, the first direction may be from the engine to a tailpipe and the second direction may be from the tailpipe to the engine. For plot 540, the status of the electric heaters varies between on and off.

Prior to t1, an engine start is requested (plot 510). During the engine start request, the catalyst temperature (plot 520) is less than the threshold 522 and the intake/exhaust valve timing is adjusted to the static timing, e.g., both the intake and exhaust valves are maintained open. The engine is not yet fueled (plot 550) and is not yet sparked (plot 560). The electric heaters are not activated (plot 540). There is no exhaust gas flow direction as a force is not applied to the exhaust gas (plot 530).

At t1, the electric heaters are activated and the exhaust gas flow direction begins to oscillate between the first direction and the second direction through the open intake and exhaust valves as the engine is cranked. The engine remains unfueled and unsparked. Between t1 and t2, the catalyst temperature increases from a relatively low temperature to the threshold 522 due to heating of the oscillating gases in the exhaust passage as the gases through pass through the electric heaters. That is to say, the exhaust gases may flow through the catalyst and through the electric heaters, repeatedly, which may accelerate warm-up of the catalyst relative to previous examples where the engine is combusted during cranking or where an electric heater directly heats the catalyst. Furthermore, by delaying combustion, emissions are reduced during the cold-start.

At t2, the catalyst temperature reached the threshold 522. As such, the engine is fueled and sparked, resulting in combustion. The intake and exhaust valve timing is adjusted to the nominal timing and the engine start request ends. The electric heaters are deactivated as the catalyst temperature is sufficiently high and able to treat a desired amount of emissions. After t2, the catalyst temperature continues to increase as hot exhaust gases flow in only the first direction as the engine combusts.

A second graph 600 is depicted in FIG. 6, illustrating operation of the electric heaters in response to non-uniform heating of catalytic substrates of an aftertreatment device, such as the aftertreatment device 70 of FIGS. 3A-3B, along with various engine operations of an engine such as engine 10 of FIG. 1. The second graph 600 includes a plot 602, illustrating if an engine start is requested, a plot 604 indicating a timing of intake and exhaust valves at the engine cylinders, a plot 606, illustrating current flow to a first electric heater, a plot 608, illustrating current flow to a second electric heater, a plot 610, illustrating current flow to a third electric heater, a plot 612, illustrating an exhaust gas flow direction, a plot 614, illustrating fueling at the engine, and a plot 616, illustrating if the engine is sparked. Time increases along the x-axis from a left to a right side of the figure.

Plots 602, 614, and 616 vary between yes and no along the y-axis. For plot 604, the valve timing is adjusted between a nominal timing, which may be a timing used when the engine is fueled and sparked to generate torque, and a static timing. Opening and closing of the intake valves and exhaust valves may be staggered during the nominal timing. During the static timing, the intake valves and exhaust valves may be opened at the same time and maintained open until commanded to return to the nominal timing. For plots 606, 608, and 610, current flow increases upwards along the y-axis. Furthermore, the first electric heater, the second electric heater, and the third electric heater may be similarly configured to first, second, and third electric heaters 303, 313, and 323 of FIGS. 3A-3B. For plot 612, the exhaust flow direction varies between no flow, a first direction, and a second direction. For example, the first direction may be from the engine to a tailpipe and the second direction may be from the tailpipe to the engine as depicted in FIGS. 3A-3B.

Prior to t1, a cold engine start is requested (plot 602) and the intake/exhaust valve timing (plot 604) is adjusted to the static timing, e.g., both the intake and exhaust valves are maintained open. The engine is not yet fueled (plot 614) and is not yet sparked (plot 616) and gas (e.g., air) is oscillated across the aftertreatment device (plot 612), between the engine and exhaust system, such that the flow alternates repeatedly between the first direction and the second direction. The first, second, and third electric heaters are powered (plots 606, 608, and 610), each drawing a similar amount of current from a common energy source, such as a battery, to increase a temperature of the electric heaters.

At t1, at least one of the catalytic substrates in contact with the second electric heater reaches a light-off temperature. The second electric heater is deactivated and stops drawing current. A differential current is distributed to each of the first electric heater and the second electric heater, thereby increasing an amount of current flowing to each electric heater and increasing a heating output at each electric heater. In response to the at least one of the catalytic substrates reaching the light-off temperature, the valve timing is adjusted to the nominal timing, the engine is fueled and sparked, and the engine start request is terminated. The exhaust flow is constrained to the first direction, from the engine to the aftertreatment device.

At t2, at least one of the catalytic substrates in contact with the third electric heater reaches the light-off temperature. The third electric heater is deactivated and stops drawing current. A differential current is directed to the first electric heater, increasing the amount of current flowing to the first electric heater and further increasing the heating output. Engine operation continues as described above prior to t2.

At least one of the catalytic substrates in contact with the first electric heater reaches the light-off temperature at t3. The first electric heater is deactivated and the current drawn by the first electric heater decreases to zero. As such, at least half of the catalytic substrates reach the light-off temperature before the electric heaters are deactivated. Engine operations continue as described above.

In this way, increased emissions during engine cold starts may be mitigated by expediting catalyst light-off. In one example, a plurality of electric heaters may rapidly heat a multi-substrate catalyst of an aftertreatment device by arranging each electric heater of the plurality of electric heaters sandwiched between catalytic substrates of the catalyst. Gases are oscillated across the aftertreatment via operation of an unfueled and unsparked engine as a pump, driving heating of the gases as they pass back-and-forth over the electric heaters. The catalytic substrates are thereby heated by the hot gases as well as by direct contact with the plurality of electric heaters. By dividing the catalyst into individual substrates separated by electric heaters, each substrate has a smaller mass than a conventional catalyst (e.g., a catalyst with a single substrate block), allowing faster overall heating of the aftertreatment device. By oscillating the hot gases, one or more inner substrates of the catalytic substrates are heated twice per engine cycle compared to outer substrates. As the inner substrates are optimized for engine cold start, faster heating at a central region of the catalyst is promoted while the outer catalytic substrates may be sized for engine peak power and load conditions where exhaust flow is high. This reduces an initial period of low catalyst conversion efficiency during cold engine starts by reducing time required for catalytic substrates to reach light-off temperature.

The technical effect of oscillating gases across the multi-substrate catalyst coupled to the plurality of electric heaters is that emissions are decreased during cold engine starts while a fuel economy of a vehicle is maintained.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The disclosure also provides support for a method for an engine, comprising: heating a catalyst of an exhaust aftertreatment device with a plurality of electric heaters during an unfueled engine operation by using the engine to oscillate air between a first direction and a second direction across the exhaust aftertreatment device. In a first example of the method, heating the catalyst includes arranging each electric heater of the plurality of electric heaters between substrates of the catalyst and wherein air is heated by the plurality of electric heaters as the air oscillates and the heated air heats the substrates of the catalyst. In a second example of the method, optionally including the first example, heating the catalyst further includes stacking the substrates in contact with the plurality of electric heaters along a direction of air flow through the exhaust aftertreatment device and heating the substrates by conduction of heat from the plurality of electric heaters to the substrates. In a third example of the method, optionally including the first and second examples, heating the catalyst during the unfueled engine operation includes opening each of an intake valve and exhaust valve of a cylinder and cranking the engine with the intake valve and the exhaust valve open and wherein the engine is cranked by an electric device. In a fourth example of the method, optionally including the first through third examples, cranking the engine while the intake valve and the exhaust valve are open includes flowing air in the first direction from an exhaust manifold to the cylinder during an intake stroke and an expansion stroke of the cylinder and flowing the air in the second direction from the cylinder to the exhaust manifold during an exhaust stroke and a compression stroke of the cylinder. In a fifth example of the method, optionally including the first through fourth examples, flowing the air in the first direction through the exhaust aftertreatment device includes sequentially heating a third substrate, a second substrate, and a first substrate of the substrates of the catalyst by the heated air. In a sixth example of the method, optionally including the first through fifth examples, flowing the air in the second direction through the exhaust aftertreatment device includes sequentially heating the second substrate, the third substrate, and a fourth substrate of the substrates of the catalyst by the heated air. In a seventh example of the method, optionally including the first through sixth examples, oscillating the air between the first direction and the second direction across the exhaust aftertreatment device includes heating the second substrate and the third substrate twice as much as the first substrate and the fourth substrate with each cylinder cycle.

The disclosure also provides support for a method for heating an exhaust aftertreatment device, comprising: responsive to a request for a cold engine start, opening an intake valve and an exhaust valve of a cylinder without fueling the cylinder, rotating a crankshaft to oscillate a first flow of air between the cylinder and an exhaust system, the exhaust system including the exhaust aftertreatment device, activating electric heaters coupled to the exhaust aftertreatment device and arranged sequentially between catalyst substrates of the exhaust aftertreatment device, and responsive to a temperature of at least one substrate of the catalyst substrates reaching a threshold, deactivating one or more of the electric heaters, adjusting actuation of the intake valve and the exhaust valve, and fueling the cylinder. In a first example of the method, oscillating the first flow of air between the cylinder and the exhaust system includes passing the first flow of air across inner substrates of the catalyst substrates twice as much as outer substrates of the catalyst substrates and wherein the catalyst substrates are arranged along a direction of the first flow of air. In a second example of the method, optionally including the first example, passing the first flow of air across the inner substrates includes passing the first flow of air through catalyst substrates configured with one or more of thin walls, at least one catalytic metal, and a wash coat to expedite heating and wherein passing the first flow of air across the outer substrates includes passing the first flow of air through catalyst substrates configured with larger volumes than the inner substrates to enable high flow rates therethrough for peak engine power output. In a third example of the method, optionally including the first and second examples, deactivating the one or more electric heaters responsive to the temperature of the at least one substrate of the catalyst substrates reaching the threshold includes deactivating at least one electric heater in contact with the at least one substrate and directing power from the deactivated at least one electric heater to active electric heaters to increase a heating rate at the active electric heaters. In a fourth example of the method, optionally including the first through third examples, adjusting the actuation of the intake valve and the exhaust valve includes adjusting a timing of intake valve opening and the exhaust valve opening to a nominal timing, the nominal timing being a valve timing optimized for engine operation when the cylinder is fueled and sparked, and wherein adjusting the actuation of the intake valve and the exhaust valve further includes adjusting the first flow of air to flow in a single direction from the cylinder to the exhaust aftertreatment device. In a fifth example of the method, optionally including the first through fourth examples, the method further comprises: rotating the crankshaft to oscillate a second flow of air between an intake manifold and the cylinder. In a sixth example of the method, optionally including the first through fifth examples, opening the intake valve and the exhaust valve responsive to the request for the cold engine start includes opening the intake valve and the exhaust valve concurrently when one or more of the temperature of the exhaust aftertreatment device is below the threshold and an engine temperature is below an optimal operating temperature.

The disclosure also provides support for an engine system, comprising: an aftertreatment device arranged in an exhaust system of the engine system, a plurality of heaters separating catalyst substrates of the aftertreatment device, a cylinder fluidly coupled to the aftertreatment device by the exhaust system, the cylinder having an intake valve and an exhaust valve, and a controller with computer readable instructions stored on non-transitory memory that, when executed, cause the controller to: responsive to a request for a cold engine start, open the intake valve and the exhaust valve of the cylinder, cycle the cylinder by rotating a crankshaft to oscillate air flow back and forth between the aftertreatment device and the cylinder, heat the aftertreatment device by activating the plurality of heaters. In a first example of the system, the catalyst substrates are arranged sequentially along a direction of gas flow in the aftertreatment device and wherein inner substrates of the catalyst substrates are configured with thin walls, a lower thermal mass than outer substrates of the catalyst substrates, and catalytic materials to expedite heating of the inner substrates. In a second example of the system, optionally including the first example, the outer substrates of the catalyst substrates are configured with substrate volumes corresponding to a maximum exhaust gas flow rate from an engine of the engine system and a displacement of the engine. In a third example of the system, optionally including the first and second examples, the aftertreatment device includes three or more catalyst substrates and the plurality of heaters includes two or more heaters and wherein the two or more heaters are operable independent of one another. In a fourth example of the system, optionally including the first through third examples, the plurality of heaters is heated to at least 1200° C. and wherein air flowing through the plurality of heaters is heated to at least 800° C.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

heating a catalyst of an exhaust aftertreatment device with a plurality of electric heaters during an unfueled engine operation by using the engine to oscillate air between a first direction and a second direction across the exhaust aftertreatment device.

2. The method of claim 1, wherein heating the catalyst includes arranging each electric heater of the plurality of electric heaters between substrates of the catalyst and wherein air is heated by the plurality of electric heaters as the air oscillates and the heated air heats the substrates of the catalyst.

3. The method of claim 2, wherein heating the catalyst further includes stacking the substrates in contact with the plurality of electric heaters along a direction of air flow through the exhaust aftertreatment device and heating the substrates by conduction of heat from the plurality of electric heaters to the substrates.

4. The method of claim 3, wherein heating the catalyst during the unfueled engine operation includes opening each of an intake valve and exhaust valve of a cylinder and cranking the engine with the intake valve and the exhaust valve open and wherein the engine is cranked by an electric device.

5. The method of claim 4, wherein cranking the engine while the intake valve and the exhaust valve are open includes flowing air in the first direction from an exhaust manifold to the cylinder during an intake stroke and an expansion stroke of the cylinder and flowing the air in the second direction from the cylinder to the exhaust manifold during an exhaust stroke and a compression stroke of the cylinder.

6. The method of claim 5, wherein flowing the air in the first direction through the exhaust aftertreatment device includes sequentially heating a third substrate, a second substrate, and a first substrate of the substrates of the catalyst by the heated air.

7. The method of claim 6, wherein flowing the air in the second direction through the exhaust aftertreatment device includes sequentially heating the second substrate, the third substrate, and a fourth substrate of the substrates of the catalyst by the heated air.

8. The method of claim 7, wherein oscillating the air between the first direction and the second direction across the exhaust aftertreatment device includes heating the second substrate and the third substrate twice as much as the first substrate and the fourth substrate with each cylinder cycle.

9. A method for heating an exhaust aftertreatment device, comprising:

responsive to a request for a cold engine start;

opening an intake valve and an exhaust valve of a cylinder without fueling the cylinder;

rotating a crankshaft to oscillate a first flow of air between the cylinder and an exhaust system, the exhaust system including the exhaust aftertreatment device;

activating electric heaters coupled to the exhaust aftertreatment device and arranged sequentially between catalyst substrates of the exhaust aftertreatment device; and responsive to a temperature of at least one substrate of the catalyst substrates reaching a threshold;

deactivating one or more of the electric heaters;

adjusting actuation of the intake valve and the exhaust valve; and fueling the cylinder.

10. The method of claim 9, wherein oscillating the first flow of air between the cylinder and the exhaust system includes passing the first flow of air across inner substrates of the catalyst substrates twice as much as outer substrates of the catalyst substrates and wherein the catalyst substrates are arranged along a direction of the first flow of air.

11. The method of claim 10, wherein passing the first flow of air across the inner substrates includes passing the first flow of air through catalyst substrates configured with one or more of thin walls, at least one catalytic metal, and a wash coat to expedite heating and wherein passing the first flow of air across the outer substrates includes passing the first flow of air through catalyst substrates configured with larger volumes than the inner substrates to enable high flow rates therethrough for peak engine power output.

12. The method of claim 9, wherein deactivating the one or more electric heaters responsive to the temperature of the at least one substrate of the catalyst substrates reaching the threshold includes deactivating at least one electric heater in contact with the at least one substrate and directing power from the deactivated at least one electric heater to active electric heaters to increase a heating rate at the active electric heaters.

13. The method of claim 9, wherein adjusting the actuation of the intake valve and the exhaust valve includes adjusting a timing of intake valve opening and the exhaust valve opening to a nominal timing, the nominal timing being a valve timing optimized for engine operation when the cylinder is fueled and sparked, and wherein adjusting the actuation of the intake valve and the exhaust valve further includes adjusting the first flow of air to flow in a single direction from the cylinder to the exhaust aftertreatment device.

14. The method of claim 9, further comprising rotating the crankshaft to oscillate a second flow of air between an intake manifold and the cylinder.

15. The method of claim 9, wherein opening the intake valve and the exhaust valve responsive to the request for the cold engine start includes opening the intake valve and the exhaust valve concurrently when one or more of the temperature of the exhaust aftertreatment device is below the threshold and an engine temperature is below an optimal operating temperature.

16. An engine system, comprising:

an aftertreatment device arranged in an exhaust system of the engine system;

a plurality of heaters separating catalyst substrates of the aftertreatment device;

a cylinder fluidly coupled to the aftertreatment device by the exhaust system, the cylinder having an intake valve and an exhaust valve; and a controller with computer readable instructions stored on non-transitory memory that, when executed, cause the controller to:

responsive to a request for a cold engine start;

open the intake valve and the exhaust valve of the cylinder without fueling the cylinder;

cycle the cylinder by rotating a crankshaft to oscillate air flow back and forth between the aftertreatment device and the cylinder;

heat the aftertreatment device by activating the plurality of heaters.

17. The engine system of claim 16, wherein the catalyst substrates are arranged sequentially along a direction of gas flow in the aftertreatment device and wherein inner substrates of the catalyst substrates are configured with thin walls, a lower thermal mass than outer substrates of the catalyst substrates, and catalytic materials to expedite heating of the inner substrates.

18. The engine system of claim 17, wherein the outer substrates of the catalyst substrates are configured with substrate volumes corresponding to a maximum exhaust gas flow rate from an engine of the engine system and a displacement of the engine.

19. The engine system of claim 16, wherein the aftertreatment device includes three or more catalyst substrates and the plurality of heaters includes two or more heaters and wherein the two or more heaters are operable independent of one another.

20. The engine system of claim 16, wherein the plurality of heaters is heated to at least 1200° C. and wherein air flowing through the plurality of heaters is heated to at least 800° C.

* * * * *